US007712505B2

(12) United States Patent
Yamada

(10) Patent No.: US 7,712,505 B2
(45) Date of Patent: May 11, 2010

(54) TAPE CUTTER DEVICE

(75) Inventor: Toshio Yamada, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/146,983

(22) Filed: Jun. 26, 2008

(65) Prior Publication Data

US 2008/0263873 A1 Oct. 30, 2008

Related U.S. Application Data

(63) Continuation of application No. PCT/JP2006/325800, filed on Dec. 25, 2006.

(30) Foreign Application Priority Data

Dec. 26, 2005 (JP) ..... 2005-372645

(51) Int. Cl.
*B32B 38/04* (2006.01)
*B32B 37/00* (2006.01)

(52) U.S. Cl. ..... 156/459; 156/443; 156/510; 156/579

(58) Field of Classification Search ..... 156/250, 156/510, 443, 459, 579; 29/900
See application file for complete search history.

(56) References Cited

U.S. PATENT DOCUMENTS 6,152,398 A * 11/2000 Chen ..... 242/588
2003/0173452 A1* 9/2003 Huang ..... 242/588
2005/0199345 A1* 9/2005 Yu ..... 156/527
2005/0242805 A1 11/2005 Honkura et al.

FOREIGN PATENT DOCUMENTS

JP 2002046931 * 2/2002

(Continued)

OTHER PUBLICATIONS

International Search Report in correspondence to International Application No. PCT/JP2006/325841 mail Mar. 20, 2007.

*Primary Examiner*—Mark A Osele
*Assistant Examiner*—Christopher C Caillouet
(74) *Attorney, Agent, or Firm*—Brinks Hofer Gilson & Lione

(57) ABSTRACT

To provide a tape cutter device that allows a cutting blade to be disposed at a non-adhesion-surface side of an adhesive tape and that can easily form a fold, including a non-adhesion portion, at a cut end portion of the adhesive tape after a cutting operation.

A structure in which a cutting blade 11 is disposed at a non-adhesion-surface side 2*b* of an adhesive tape 2, and is provided so as to be rotatable in a drawing-out direction of the adhesive tape 2 as the adhesive tape 2 is drawn out; in which a torsion spring 17 that biases the cutting blade 11 in a direction opposite to the drawing-out direction of the adhesive tape 2 is provided; and in which a rotating roller 18 is disposed at a holding-portion-3 side near the cutting blade 11 so that the non-adhesion surface 2*b* of the adhesive tape 2 is wound thereupon, and rotates as the adhesive tape 2 is drawn out, to form a fold 2*b*, including a non-adhesion portion, at a cut end portion of the adhesive tape 2 so as to be situated between the rotating roller 18 and the cutting blade 11 when the adhesive tape 2 is cut.

7 Claims, 18 Drawing Sheets

FOREIGN PATENT DOCUMENTS

| | | |
|---|---|---|
| JP | 2003-197848 | 7/2003 |
| JP | 2004-125778 | 4/2004 |
| JP | 2004-191065 | 7/2004 |
| JP | 2005-233620 | 9/2005 |

* cited by examiner

TAPE CUTTER DEVICE

The present application is a continuation of PCT Application No. PCT/JP2006/325800, filed Dec. 25, 2006, which claims priority to Japanese Patent Application No. 2005-372645, filed on Dec. 26, 2005. Both of these applications are incorporated by reference for all purposes.

TECHNICAL FIELD

The present invention relates to a tape cutter device that can form a fold, including a non-adhesion portion, by folding a cut end portion of a cut adhesive tape.

BACKGROUND ART

Such a related art is discussed in Patent Document 1. A structure according to the related art includes a reel, that is, a holding portion, and a cutting blade. The reel can hold an adhesive tape having an adhesion surface at one side thereof and a non-adhesion surface at the other side thereof. The cutting blade is rotatably disposed at the adhesion surface-side of the adhesive tape, and cuts the adhesive tape drawn out from the holding portion by pinching the adhesive tape with a finger. In addition, the structure also includes a circular cylindrical A structure according to the related art includes a reel, that is, a holding portion, and a cutting blade. The reel can hold an adhesive tape having an adhesion surface at one side thereof and a non-adhesion surface at the other side thereof. The cutting blade is rotatably disposed at the adhesion surface-side of the adhesive tape, and cuts the adhesive tape drawn out from the holding portion by pinching the adhesive tape with a finger. In addition, the structure also includes a circular cylindrical waiting portion that forms a pinch portion, that is a fold, including a non-adhesion portion, by folding a cut end portion of the cut adhesive tape between it and the cutting blade.

In the related art having such a structure, the adhesive tape is applied to a required location by, for example, pinching and drawing out with finger tips the fold of the adhesive tape so that the adhesive tape has a length equivalent to an entire length of a predetermined adhesion area. In addition, after adhering the adhesive tape to the required location, the adhesive tape can be simply peeled off by pinching and pulling upward with the finger tips the fold including the non-adhesion portion of the adhesive tape.

Patent Document 1: Japanese Patent No. 2958331

DISCLOSURE OF THE INVENTION

Problems to be Solved by the Invention

To improve working efficiency of an adhering operation of an adhesive tape, the following case may occur. That is, when adhering the adhesive tape to an adhesion member, such as a corrugated cardboard, unlike in the foregoing description, an end of the adhesive tape is only adhered to the adhesion member without adhering the adhesive tape as a result of drawing out the adhesive tape so that its length becomes equivalent to the entire length of the predetermined adhesion area. Then, a body side holding the adhesive tape is moved to adhere the adhesive tape to the predetermined adhesion area. When the adhesive tape is applied in this way, unlike the structure according to the above-described related art, the cutting blade is disposed at the non-adhesion-surface side opposite to the adhesion surface of the adhesive tape. However, when the cutting blade is simply disposed at the non-adhesion-surface side of the adhesive tape, it becomes difficult to form the fold, including the non-adhesion portion, which is a convenient portion when peeling off the adhesive tape from the adhesion member.

The present invention is achieved in view of the actual situation in the above-described related art, and has as its object the provision of a tape cutter device that allows a cutting blade to be disposed at a non-adhesion-surface side of an adhesive tape and that can easily form a fold, including a non-adhesion portion, at a cut end portion of the adhesive tape after a cutting operation.

Means for Solving the Problems

To this end, a tape cutter device includes a holding portion capable of holding an adhesive tape having an adhesion surface at one side thereof and a non-adhesion surface at the other side thereof; a drawing-out portion where the adhesive tape held by the holding portion is drawn out; a cutting blade which cuts the adhesive tape drawn out from the drawing-out portion, which is disposed at the non-adhesion-surface side of the adhesive tape, and which is provided so as to be rotatable in a drawing-out direction of the adhesive tape as the adhesive tape is drawn out; a biasing member that biases the cutting blade in a direction opposite to the drawing-out direction of the adhesive tape; and a rotating roller which is disposed at the holding-portion side near the cutting blade so that the non-adhesion surface of the adhesive tape is wound thereupon, and which rotates as the adhesive tape is drawn out, to form a fold, including a non-adhesion portion, at a cut end portion of the adhesive tape so as to be situated between the rotating roller and the cutting blade when the adhesive tape is cut.

According to the invention having such a structure, when the adhesive tape is adhered to an adhesion member, such as a corrugated cardboard, first, an end portion of the adhesive tape is adhered to the adhesion member. Then, while drawing out the adhesive tape by moving a body side including the holding portion, the drawn-out portion of the adhesive tape is successively adhered to the adhesion member. Here, the cutting blade held in an inwardly moved state is rotated in the drawing-out direction against a biasing force of the biasing member as the adhesive tape is drawn out from the drawing-out portion, and is moved outward. During this time, a rotating roller upon which the adhesive tape is wound is rotated due to the drawing-out operation of the adhesive tape. In this way, the adhesive tape is adhered to an entire predetermined adhesion area of an adhesion member. Thereafter, this adhesive tape is cut with the cutting blade disposed at the non-adhesion-surface side. When the adhesive tape is cut with the cutting blade, inertia of the rotating roller can flex the cut end portion of the adhesive tape so that the adhesion surface is positioned at the inner side. Subsequent to this operation, the cutting blade is rotated by a biasing force of the biasing member in a direction opposite to the drawing-out direction of the tape, that is, in an inwardly moving direction. The rotation of the cutting blade causes the cut end portion of the adhesive tape flexed as described above to be folded between the cutting blade and the rotating roller, so that a fold, including the non-adhesion portion, is formed. According to this invention, the cutting blade can be disposed at the non-adhesion-surface side of the adhesive tape, and a fold, including the non-adhesion portion, can be easily formed at the cut end portion of the adhesive tape through the biasing force of the biasing member after the cutting.

According to the present invention, in the above-described invention, a guide member may be provided at an inner-side portion, situated at the holding-portion side, of the cutting blade, the guide member contacting the non-adhesion surface of the adhesive tape drawn out from the holding portion to rotate the cutting blade in the drawing-out direction of the adhesive tape against a biasing force of the biasing member. According to the invention having such a structure, in adhering the adhesive tape, when the adhesive tape is drawn out from the drawing-out portion, the guiding member contacts the non-adhesion surface of the drawn-out adhesive tape, and rotates in the drawing-out direction, thereby causing the cutting blade to rotate. That is, when the adhesive tape is drawn out, the cutting blade can be prevented from contacting the adhesive tape. This makes it possible to smoothly move outward the cutting blade without scratching the drawn out adhesive tape by the cutting blade.

According to the present invention, in the above-described inventions, a folding positioning portion with which the fold of the adhesive tape comes into contact may be provided. According to the invention having such a structure, a flexed portion of the cut adhesive tape is brought into contact with the folding positioning portion, so that the adhesive tape can be properly folded, and a fold, including a non-adhesion portion, having the same length can be formed with each cutting operation of the adhesive tape.

According to the present invention, in the above-described inventions, a stopper portion that restricts an amount of rotation of the cutting blade in the drawing-out direction of the adhesive tape may be provided. According to the invention having such a structure, restricting the rotation of the cutting blade with the stopper portion makes it possible to maintain a constant distance between the rotating roller and an edge of the cutting blade when cutting the adhesive tape. Therefore, a fold, including a non-adhesion portion, having the same length can be formed at all times.

According to the present invention, in the above-described inventions, protrusions may be disposed on two respective sides of an edge of the cutting blade so as to protrude beyond the edge. According to the invention having such a structure, when the adhesive tape is drawn out, while the protrusions are in contact with an adhesion member, such as a corrugated cardboard, the cutting blade can be moved outward. In addition, it is possible to prevent the cutting edge from contacting other objects when, for example, carrying the tape cutter device.

According to the present invention, in the above-described inventions, the rotating roller may be formed of a rubber member having viscosity. According to the invention having such a structure, when the adhesive tape is drawn out, the drawn-out adhesive tape is drawn out while being adhered to the rotating roller by the viscosity of the rotating roller. Even during the cutting of the adhesive tape after the drawing out of the adhesive tape, the cut end portion of the adhesive tape is adhered to and held by the rotating roller. This makes it easier for the cut end portion of the adhesive tape to be flexed into a recessed form so that its adhesion-surface side is set at the inner side. Accordingly, the cut end portion of the adhesive tape can be more reliably folded.

According to the present invention, in the above-described inventions, a static electricity generating member is provided at an outer peripheral surface of the rotating roller. According to the invention having such a structure, when cutting the adhesive tape, the flexed cut end portion of the adhesive tape can be adhered to and held by the rotating roller by static electricity of the static electricity generating member of the rotating roller.

According to the present invention, in the above-described inventions, a finger placing portion that rotates the cutting blade in the drawing-out direction of the adhesive tape against a/the biasing force of the biasing member by a pressing operation with a finger tip may be provided. According to the invention having such a structure, for example, pressing the finger placing portion with a finger tip while the adhesive tape held by the holding portion is grasped makes it possible to move outward the cutting blade and to easily carry out an adhesion operation of the adhesive tape, so that the tape cutter device is easy to use.

According to the present invention, in the above-described inventions, a pair of the finger placing portions may be provided in correspondence with two respective sides/the two respective sides of the cutting blade. According to the invention having such a structure, the tape cutter device can be easily used by a right-handed person and a left-handed person, and can, thus, be very easily used.

Advantages of the Invention

The present invention makes it possible to dispose the cutting blade at the non-adhesion-surface side of the adhesive tape, and to easily form a fold, including the non-adhesion portion, by folding the cut end portion of the adhesive tape after cutting the adhesive tape. Therefore, the adhesive tape adhered to an adhesion member can be easily peeled off as a result of grasping the fold. In addition, an adhesion operation of the adhesive tape carried out by moving the body side of the adhesive tape can be carried out, so that the efficiency with which the adhesive tape is adhered can be increased.

Best Modes for Carrying Out the Invention

Best modes for achieving a tape cutter device according to the present invention will hereunder be described with reference to the drawings.

Structure of the Embodiment

FIG. 1 shows a tape cutter device according to an embodiment of the present invention, and is a side view showing a state in which a cutting blade is moved inward.

FIG. 2 shows the tape cutter device as seen from a direction A in FIG. 1. FIG. 3 shows a state in which the cutting blade is moved outward from the state shown in FIG. 2. FIG. 4 shows the tape cutter device as seen from a direction B in FIG. 1. FIG. 5 shows a state in which the cutting blade is moved outward from the state shown in FIG. 4. FIG. 6 shows the tape cutter device as seen from a direction C in FIG. 1. FIG. 7 shows a state in which the cutting blade is moved outward from the state shown in FIG. 6. FIG. 8 shows the cutting blade provided in the embodiment, with FIG. 8(*a*) being a front view of the main portion and FIG. 8(*b*) being a side view.

As shown in FIG. 1, the tape cutter device according to the embodiment includes a body 1, a holding portion 3, and a drawing-out portion 4. The holding portion 3 is included in the body 1 and can hold an adhesive tape 2 having an adhesion surface 2*a* at one side thereof and a non-adhesion surface 2*b* at the other side thereof. The adhesive tape 2 held by the holding portion 3 is drawn out from the drawing-out portion 4. The drawing-out portion 4 includes a roller member 5 that contacts the adhesion surface 2*a* of the drawn-out adhesive tape 2, so as to rotate. A handle 6, disposed so as to oppose the outer peripheral surface of the adhesive tape 2 held by the holding portion 3, is mounted to the body 1.

A first frame member 7 is secured to the body 1 with a screw 8 shown in FIG. 2. A second frame member 10 is rotatably mounted to a shaft 9 mounted to the first frame member 7. The upper portion of the second frame member 10 has a stopper portion 10*a* and finger placing portions 10*b*. The stopper portion 10*a* engages the first frame member 7 as the second frame member 10 rotates, that is, restricts the amount of rotation of the second frame member 10. The finger placing portion 10*b* allow the second frame member 10 to rotate with a finger tip. A pair of left and right protrusions 12 are provided at the lower portion of the second frame member 10.

As shown in FIG. 2, a cutting blade 11, which cuts the adhesive tape 2, is secured to the second frame member 10 with bolts 16. That is, the cutting blade 11 rotates with the second frame member 10 in a drawing-out direction of the adhesive tape 2 as the adhesive tape 2 is drawn out. Therefore, the stopper 10*a*, provided at the second frame member 10, restricts the amount of rotation of the cutting blade 11. The state shown in FIG. 1 is a state in which the aforementioned cutting blade 11 is moved inward.

The protrusions 12 at the aforementioned second frame member 10 are disposed at respective two sides of the cutting blade 11 so the cutting blade 11 is disposed between the protrusions 12, and protrude beyond edges 11*a* of the cutting blade 11.

As shown in FIG. 8(*a*), each edge 11*a* of the cutting blade 11 has, for example, a wedge shape. Each wedge-shaped edge 11*a* of the cutting blade 11 forms a holding portion that holds a cut end portion of the adhesive tape 2 by adhesion when the adhesive tape 2 is cut.

As shown in FIG. 5, a biasing member, such as a torsion spring 17, that biases the cutting blade 11, integrally formed with the second frame member 10, in a direction opposite to the drawing-out direction of the adhesive tape 2 is mounted to the shaft 9.

In the embodiment, as shown in FIG. 1, a rotating roller 18 is disposed at the holding-portion-3 side near the cutting blade 11 so that the non-adhesion surface 2*b* of the adhesive tape 2 is wound thereupon. The rotating roller 18 rotates when the adhesive tape 2 is drawn out, to form a fold 2*d* (described later), including the non-adhesion portion, at the cut end portion of the adhesive tape 2 so as to be situated between the cutting blade 11 and the rotating roller 18 when the adhesive tape 2 is cut with the cutting blade 11. The rotating roller 18 is formed of, for example, a rubber member having viscosity, and is mounted to the body 1.

As shown in FIGS. 5, 7, and 8(*b*), a guide member, such as a leaf spring 13, is provided at an inner portion, situated at the holding-portion-3 side, of the cutting blade 11. The guide member contacts the non-adhesion surface 2*b* of the adhesive tape 2 drawn out from the holding portion 3, to rotate the cutting blade 11 in the direction of the drawing-out direction of the adhesive tape 2 against a biasing force of the torsion spring 17. The upper portion of the leaf spring 13 has a folding positioning portion 13*a* that the fold 2*d* (described later) of the adhesive tape 2 contacts.

As shown in FIG. 8(*b*), a resilient spacer 15 is disposed between the cutting blade 11 and the leaf spring 13. As shown in FIGS. 5, 7, and 8(*b*), a synthetic resin plate 14 that constitutes a static electricity generating member is disposed at the holding-portion-3 side near the cutting blade 11, for example, at the inner side of the leaf spring 13. Similarly to each wedge-shaped edge 11*a* of the aforementioned cutting blade 11, the synthetic resin plate 14 also forms a holding portion that holds the cut end portion of the adhesive tape 2 by adhesion through static electricity when the adhesive tape 2 is cut with the cutting blade 11.

That is, the cutting blade 11, the spacer 15, the leaf spring 13, and the synthetic resin plate 14, which are shown in FIG. 8(*b*), are secured to the second frame member 10 with the bolts 16 shown in, for example, FIGS. 2 and 3, so as to be integrally provided.

The finger placing portions 10*b* of the aforementioned second frame member 10 allow the second frame member 10 to rotate as mentioned above. That is, the finger placing portions 10*b* cause the cutting blade 11, integrally formed with the second frame member 10, to rotate in the drawing-out direction of the adhesive tape 2 against a biasing force of the torsion spring 17 by a pressing operation with a finger tip. For example, a pair of the finger placing portions 10*b* are provided at respective two sides of the cutting blade 11.

Adhesion Operation of Adhesive Tape

FIGS. 10 to 20 illustrate an adhesion operation of the adhesive tape. FIG. 10 is a side view showing a state immediately before the adhesion operation of the adhesive tape is carried out. FIG. 11 is a side view showing a state when the adhesion operation of the adhesive tape is started. FIG. 12 is an enlarged view of a main portion in a state substantially in correspondence with the state shown in FIG. 11. FIG. 13 is a side view showing a state in which the adhesion operation of the adhesive tape is being carried out. FIG. 14 is an enlarged view of a main portion in a state substantially in correspondence with the state shown in FIG. 13. FIG. 15 is a side view showing a state when the adhesive tape is being cut. FIG. 16 is an enlarged view of a main portion in a state substantially in correspondence with the state shown in FIG. 15. FIG. 17 is a side view showing a state immediately after the adhesive tape is cut. FIG. 18 is an enlarged view of a main portion in a state substantially in correspondence with the state shown in FIG. 17. FIG. 19 is a side view showing a state when a fold at the cut end portion of the adhesive tape is formed. FIG. 20 is an enlarged view of a main portion in a state substantially in correspondence with the state shown in FIG. 19.

When the adhesive tape 2 is to be adhered to an adhesion member, such as a corrugated cardboard 20, as shown in FIG. 10, for example, the palm of a hand is brought into contact with the handle 6. While the adhesive tape 2 held by the holding portion 3 is grasped, the adhesion surface 2*a* of an end of the adhesive tape 2 wound upon the rotating roller 18 is brought close to the corrugated cardboard. As shown in FIGS. 11 and 12, the end of the adhesive tape 2 is pressed by the rotating roller 18 and is adhered to the corrugated cardboard 20. Then, from this state, the body-1 side is made to start moving along a predetermined adhesion area. Accordingly, as shown by an arrow 21 shown in FIG. 11, the second frame member 10, held in an inwardly moved state up to this time, is rotated together with the cutting blade 11 and the leaf spring 13 in the drawing-out direction of the adhesive tape 2 against a biasing force of the torsion spring 17, so that the cutting blade 11 is set in an outwardly moved state. At this time, first, the protrusions 12 contact the corrugated cardboard 20, after which the leaf spring 13 contacts the corrugated cardboard 20.

When the body 1 is subsequently moved along the predetermined adhesion area, as shown in FIGS. 13 and 14, the leaf spring 13 is flexed as a result of contacting the non-adhesion surface 2*b* of the adhesive tape 2. A resilient force of the leaf spring 13 resulting from this flexing and a pressing force transmitted through the rotating roller 18 are applied to the adhesive tape 2, so that the adhesive tape 2 is firmly adhered to the predetermined adhesion area. While the adhesive tape 2 is drawn out in this way, the roller member 5 rotates while contacting the adhesion surface 2*a* of the adhesive tape 2, and the rotating roller 18 rotates while contacting the non-adhesion surface 2*b* of the adhesive tape 2.

When the adhesive tape 2 is adhered to the entire predetermined adhesion area, and reaches a cutting position, as shown in FIGS. 15 and 16, the cutting blade 11, disposed at the non-adhesion-surface-2*b* side of the adhesive tape 2, cuts the adhesive tape 2. At this time, inertia of the rotating roller 18 that was rotating due to the drawing out of the adhesive tape 2 causes the rotating roller 18 to rotate slightly in the drawing-out direction as indicated by an arrow 22 shown in FIG. 18.

The rotation due to the inertia of the rotating roller 18 causes the cut end portion of the adhesive tape 2 to be flexed into a recess form so that the adhesion surface 2*a* is positioned at the inner side, thereby forming a flex portion 2*c* in the adhesive tape 2 as shown in FIGS. 17 and 18. At this time, the cut end portion of the adhesive tape 2 is adhered to each edge 11*a* of the cutting blade 11, so as to be held by the edges 11*a*.

Subsequent to this operation, as shown by an arrow 23 shown in FIGS. 19 and 20, a biasing force of the torsion spring 17 causes the second frame member 10 to be rotated together with the cutting blade 11 and the leaf spring 13 in a direction opposite to the drawing-out direction of the adhesive tape 2, that is, in a direction in which the cutting blade 11 is moved inward. While the flex portion 2*c* of the adhesive tape 2 is adhered to and held by the synthetic resin plate 14 by static electricity generated by the synthetic resin plate 14, the rotation of the cutting blade 11 and the leaf spring 13 causes a fold 2*d*, including the non-adhesion portion, to be formed so as to be situated between the cutting blade 11 and the rotating roller 18 and between the leaf spring 13 and the rotating roller 18 by a folding operation while the adhesive tape 2 is in contact with the folding positioning portion 13*a* of the leaf spring 13.

FIG. 21 also shows the adhesion process of the adhesive tape, and is a side view showing a different method of moving outward the cutting blade 11. Instead of moving outward the cutting blade 11 by the movement of the body 1 as mentioned above, as shown in FIG. 21, the cutting blade 11 may be moved outward by rotating the second frame member 10 as a result of placing a finger tip on either one of the pair of finger placing portions 10*b* of the second frame member 10.

Advantages of the Embodiment

According to the embodiment having the aforementioned structure, as mentioned above, the cutting blade 11 can be disposed at the non-adhesion surface 2*b* of the adhesive tape 2, and the fold 2*d*, including the non-adhesion portion, can be easily formed at the cut end portion of the adhesive tape 2 through a biasing force of the torsion spring 17 after the cutting operation. This makes it possible to easily peel off the adhesive tape 2 adhered to the corrugated cardboard 20, which is an adhesion member, as a result of grasping the fold 2*d*. In addition, the adhesion operation of the adhesive tape 2 carried out by moving the body-1 side of the adhesive tape 2 can be carried out, so that the efficiency with which the adhesive tape 2 is adhered can be improved.

Since the guide member, that is, the leaf spring 13 is provided at the back side of the cutting blade 11, the cutting blade 11 can be prevented from contacting the adhesive tape 2 when drawing out the adhesive tape 2. By this, the cutting blade 11 can be smoothly moved outward without scratching the drawn-out adhesive tape 2 with the cutting blade 11, so that reliability of the adhesion operation can be ensured.

The folding positioning portion 13*a* that contacts the fold 2*d* when forming the fold 2*d* at the cut end portion of the adhesive tape 2 is provided. Therefore, bringing the flex portion 2*c* of the cut adhesive tape 2 into contact with the folding positioning portion 13*a* makes it possible to properly fold the adhesive tape 2, and to form a fold 2*d*, including a non-adhesion portion, having the same length every time the adhesive tape 2 is cut. Therefore, the folds 2*d* can be manufactured with high precision.

The second frame member 10 has the stopper portion 10*a* that restricts the amount of rotation of the cutting blade 11 when the cutting blade 11 rotates. Therefore, it is possible to keep constant the distance between the rotating roller 18 and each edge 11*a* of the cutting blade when cutting the adhesive tape 2 while the cutting blade 11 is maximally moved outward as a result of stopping the stopper portion 10*a* by the first frame member 7. This makes it possible to form the fold 2*d*, including the non-adhesion portion, having the same length at all times, thereby contributing to manufacturing the fold 2*d* with high precision.

The protrusions 12 protruding beyond the edges 11 are provided at the respective two sides of the edges 11*a* of the cutting blade 11. Therefore, when the adhesive tape 2 is drawn out, the cutting blade 11 can be moved outward while the protrusions 2 are in contact with the corrugated cardboard 20, so that the corrugated cardboard 20 is not scratched. In addition, it is possible to prevent the cutting edges 10*a* from contacting other objects when, for example, carrying the tape cutter device. Therefore, the tape cutter device is a highly safe device.

The rotating roller 18 is formed of a viscous rubber member. Therefore, even when the adhesive tape 2 is cut, the cut end portion of the adhesive tape 2 is adhered to and held by the rotating roller 2 through the viscosity. Consequently, the cut end portion of the adhesive tape 2 is more easily flexed into a recess form so that the adhesion-surface-2*a* side is positioned at the inner side as mentioned above. Accordingly, the cut end portion of the adhesive tape 2 can be more reliably folded, thereby contributing to manufacturing the fold 2*d* with high precision.

The holding portions that hold the cut end portion of the adhesive tape 2 when the adhesive tape 2 has been cut with the cutting blade 11, that is, the wedge-shaped edges 11*a* of the cutting blade 11 and the synthetic resin plate 14, serving as a static electricity generating member, are provided. Therefore, when the adhesive tape 2 has been cut, the cut end portion is reliably folded through holding forces of these holding portions, so that a fold having a constant geometric dimension can be formed. Consequently, when the adhesive tape 2 is adhered to the corrugated cardboard 20, which is an adhesion member, an excellent external appearance can be ensured.

When the adhesive tape 2 is cut, the wedge-shaped edges 11*a* of the cutting edge 11 and the synthetic resin plate 14, serving as a static electricity generating member, are provided as holding portions that hold the cutting edge portion. The wedge-shaped edges 11*a* of the cutting blade 11 are formed when the cutting blade 11 is manufactured, and the synthetic resin plate 14 has a simple shape. Therefore, the holding portions including the edges 11*a* of the cutting blade 11 and the synthetic resin plate 14 can be easily formed.

The finger placing portions 10*b* that rotate the cutting blade 11 in the drawing-out direction of the adhesive tape 2 against a biasing force of the torsion spring 17 by a pressing operation with a finger tip are provided. Therefore, by pressing the finger placing portions 10*b* with the finger tip while the adhesive tape 2 held by the holding portion is grasped, it is possible to facilitate the adhesion operation of the adhesive tape after moving outward the cutting blade 11. Consequently, the tape cutter device is easy to use. In particular, since a pair of finger placing portions 10*b* are provided at respective sides of the cutting blade 11, the tape cutter device can be easily used by a right-handed person and a left-handed person, and can, thus, be very easily used.

Other Embodiments

FIG. 9 shows another mountable cutting blade in an embodiment. As shown in FIG. 9, cutting blades in the embodiment include another cutting blade 25 in addition to a cutting blade 11. An adhesive tape 2 can be cut with edges 25*a* of the other cutting blade 25. In this case, for example, a spacer 15*a* having a resiliency that is equivalent to that of the spacer 15 is disposed between a leaf spring 13 and the cutting blade 25. A synthetic resin plate 26, constituting a static electricity generating member, is disposed at the inner-side portion of the other cutting blade 25, that is, at a holding-portion-3 side. The cutting blade 11, the spacer 15, the leaf spring 13, the spacer 15*a*, the other cutting blade 25, and the synthetic resin plate 26 may be secured to a second frame 10 with the bolts 16 shown in FIG. 2, so as to be integrally formed.

In such a structure, since a cutting operation using the cutting blade 11 and a cutting operation using the other cutting blade 25 can both be carried out, a cutting function with respect to the adhesive tape 2 can be enhanced.

Although, in the embodiment, a rotating roller 18 is formed of a rubber member having viscosity, the rotating roller 18 may be one having, for example, a static electricity generating function, that is, may be formed of synthetic resin that forms a static electricity generating member. In addition, the rotating roller 18 may be formed of a rubber member having viscosity, and having, for example, a synthetic resin sheet, serving as a static electricity generating member, adhered to a portion of the outer peripheral surface thereof.

In the structure including the static electricity generating member at the outer peripheral surface of the rotating roller 18 in this way, when a fold 2*d* is to be formed at a cut end portion of the adhesive tape 2, a flex portion 2*c* of the adhesive tape 2 can be adhered to and held by the rotating roller 18 by static electricity generated from the static electricity generating member. This contributes to manufacturing the fold 2*d* with high precision.

In the above-described embodiment, wedge-shaped edges 11*a* of the cutting blade 11 and a synthetic resin plate 14, disposed at the back of the leaf spring 13, are provided as holding portions that hold a cut end portion thereof when the adhesive tape 2 is cut. However, instead of these structures or in addition to these structures, it is possible to provide stopper portions that are disposed at respective sides of the edges 11*a* of the cutting blade 11 and that stop the adhesive tape 2 by piercing the cut adhesive tape 2.

In such a structure, the stopper portions can be formed with a simple structure that allows them to pierce the adhesive tape 2. In addition, by causing the cut end portion of the adhesive tape 2 to be pierced by the stopper portions, the cut end portion can be reliably folded, thereby contributing to manufacturing the fold 2*d* with high precision.

REFERENCE NUMERALS

Figure 1:
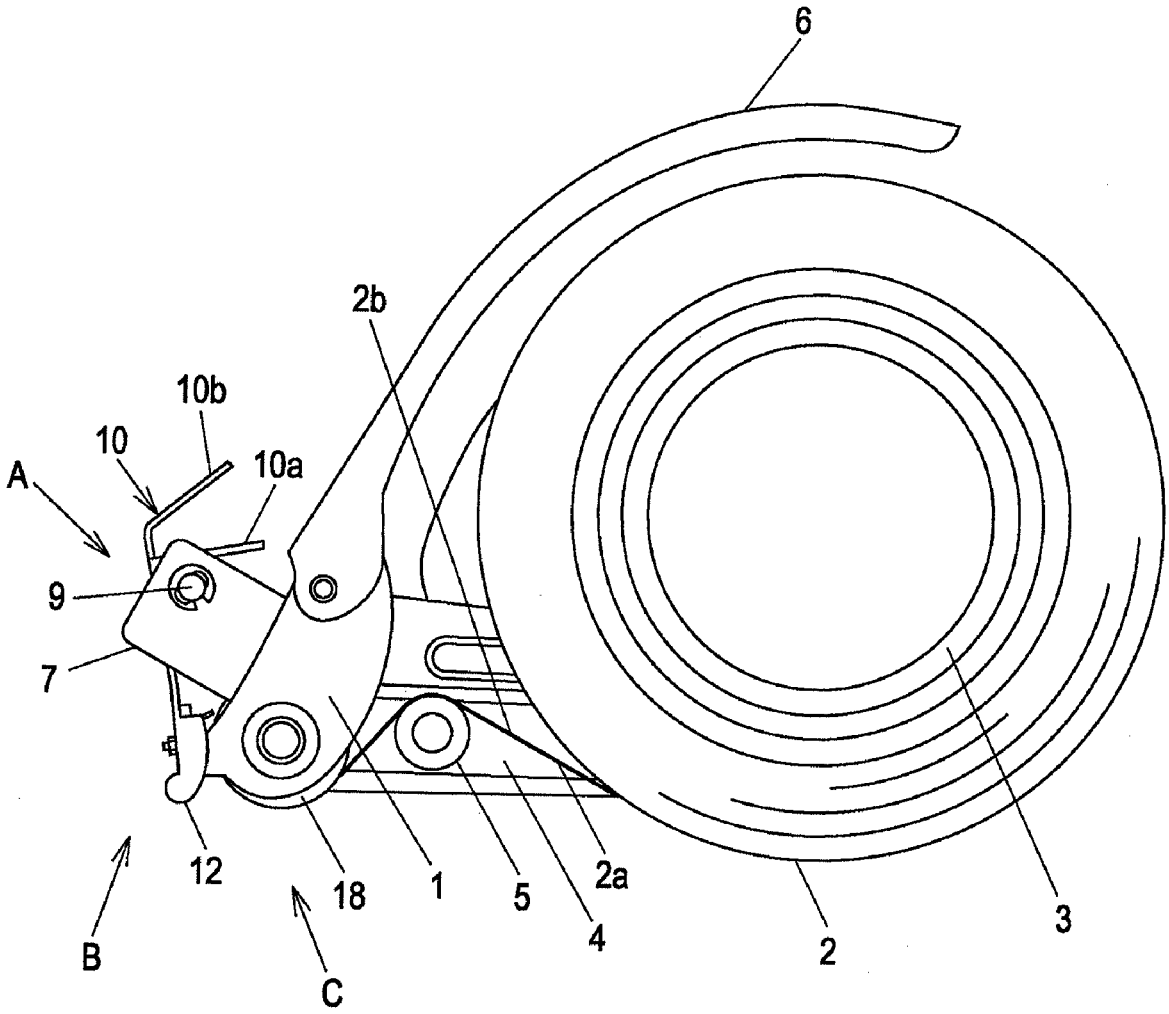
FIG. 1 shows a tape cutter device according to an embodiment of the present invention, and is a side view showing a state in which a cutting blade is moved inward.
Figure 2:
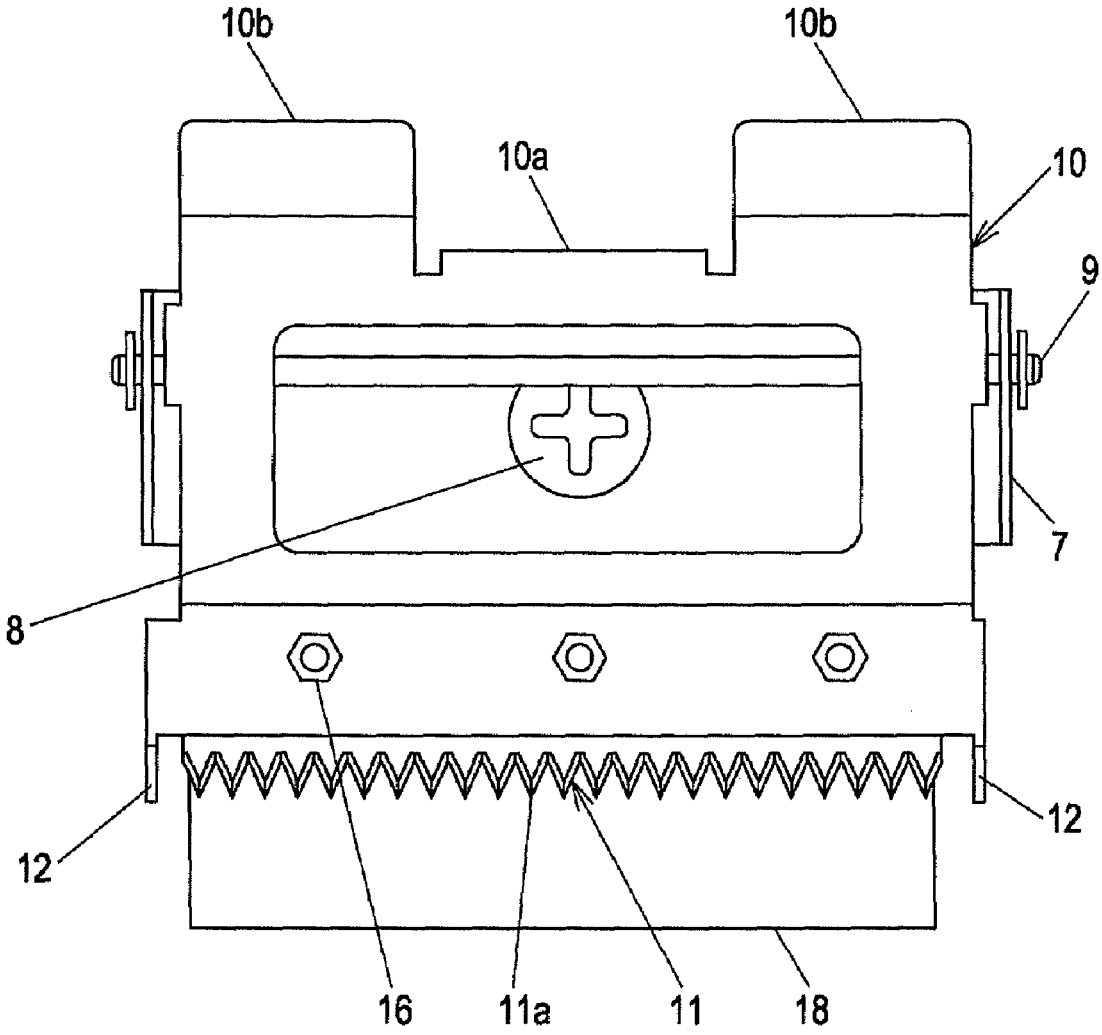
FIG. 2 shows the tape cutter device as seen from a direction A in FIG. 1.
Figure 3:
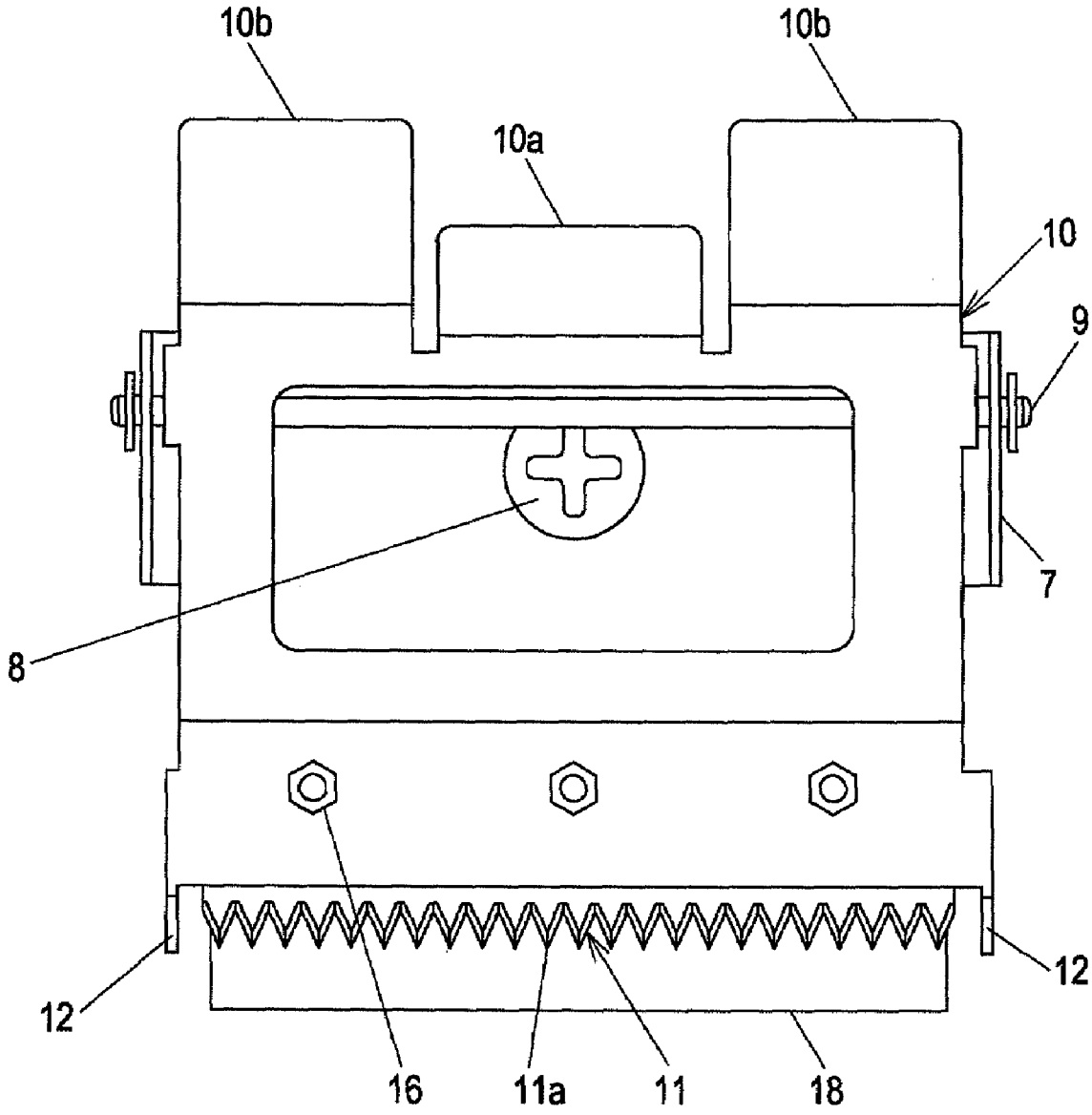
FIG. 3 shows a state in which the cutting blade is moved outward from the state shown in FIG. 2.
Figure 4:
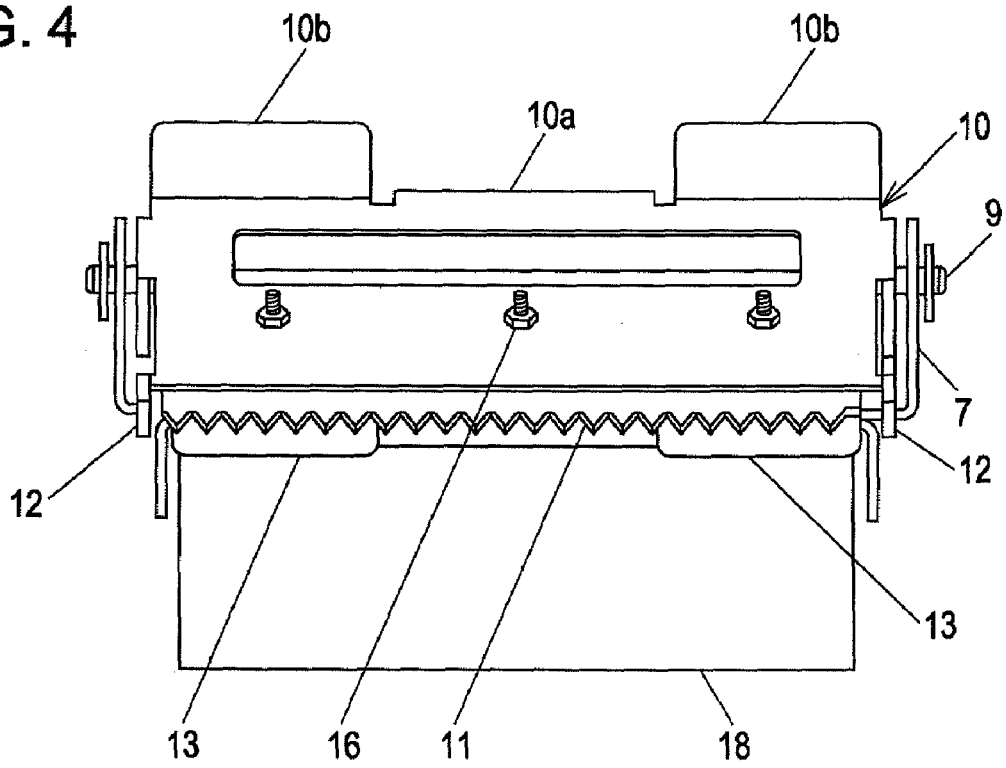
FIG. 4 shows the tape cutter device as seen from a direction B in FIG. 1.
Figure 5:
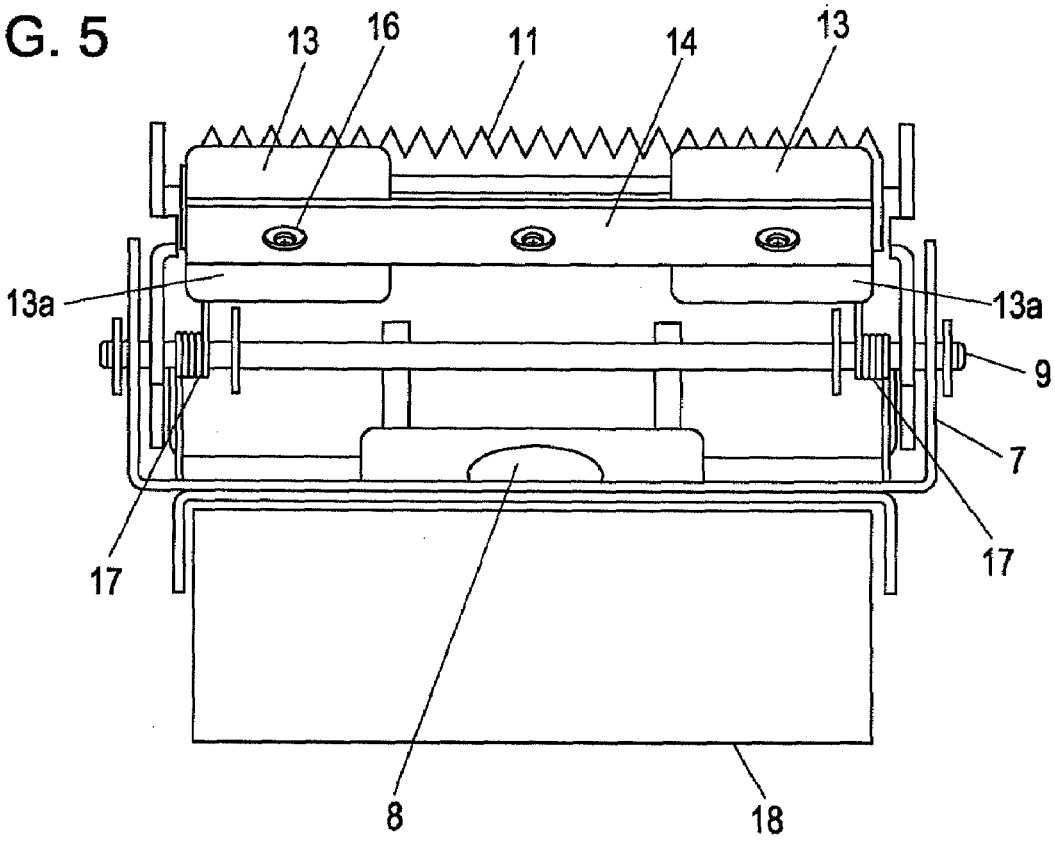
FIG. 5 shows a state in which the cutting blade is moved outward from the state shown in FIG. 4.
Figure 6:
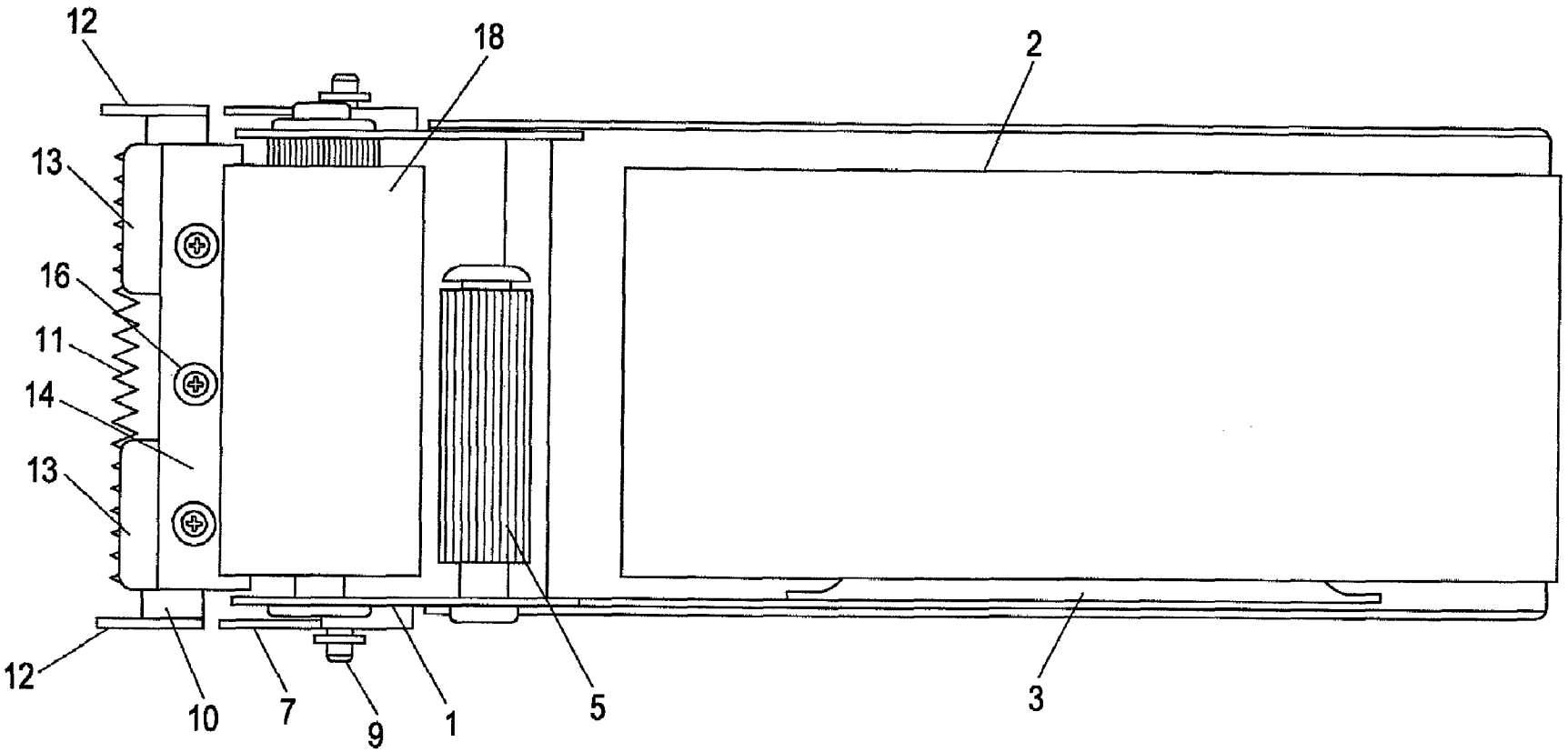
FIG. 6 shows the tape cutter device as seen from a direction C in FIG. 1.
Figure 7:
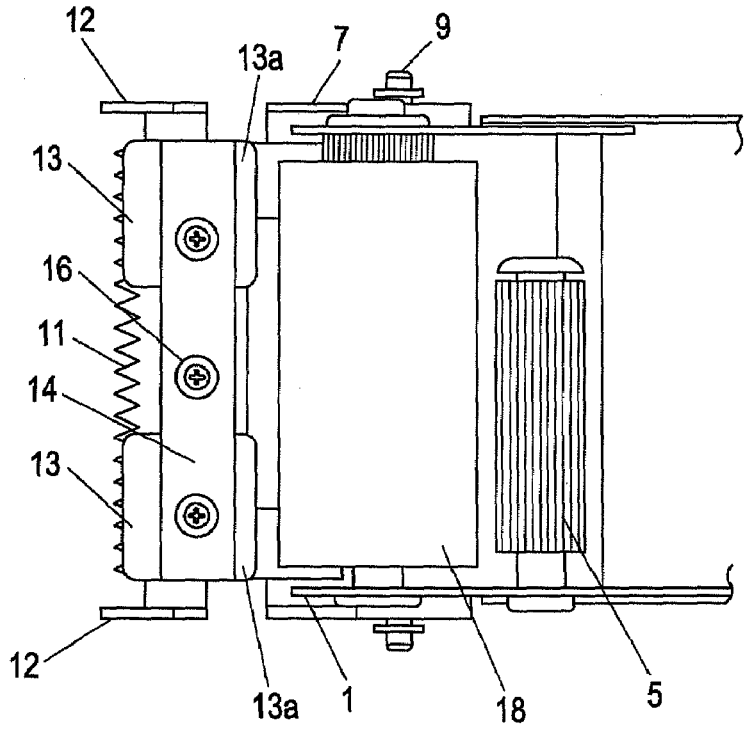
FIG. 7 shows a state in which the cutting blade is moved outward from the state shown in FIG. 6.
Figure 8:
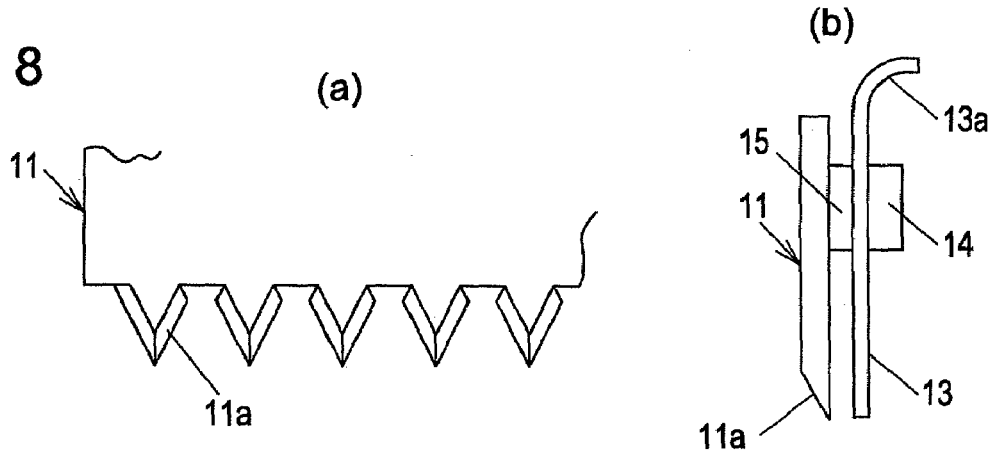
FIG. 8 shows the cutting blade provided in the embodiment, with FIG. 8(*a*) being a front view of the main portion and FIG. 8(*b*) being a side view.
Figure 9:
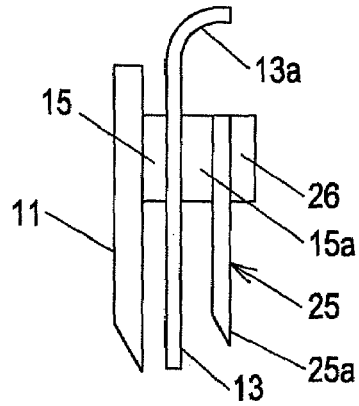
FIG. 9 shows another mountable cutting blade in an embodiment.
Figure 10:
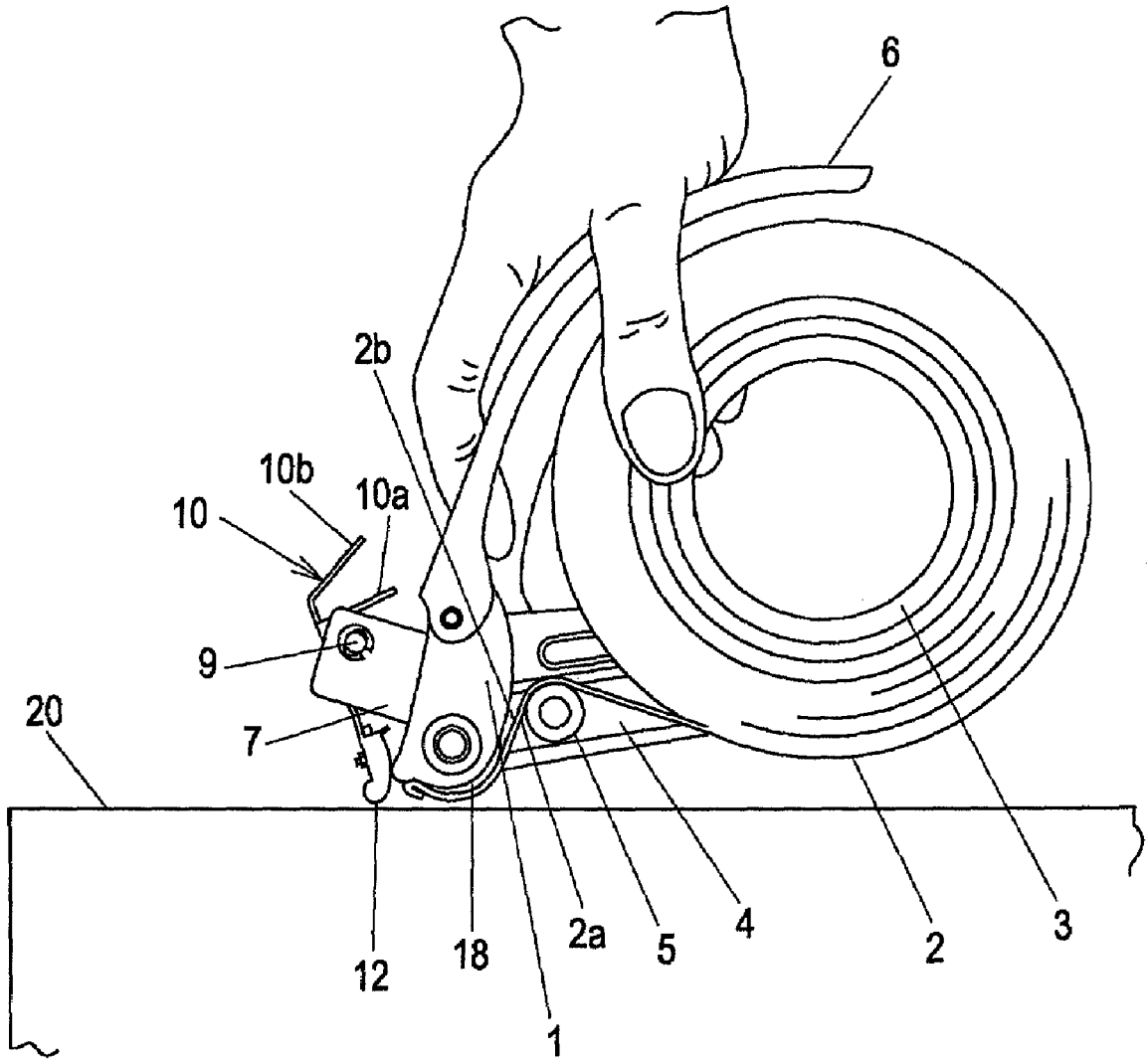
FIG. 10 is used to illustrate an adhesion process of an adhesive tape, and is a side view showing a state immediately before an adhesion operation of the adhesive tape is carried out.
Figure 11:
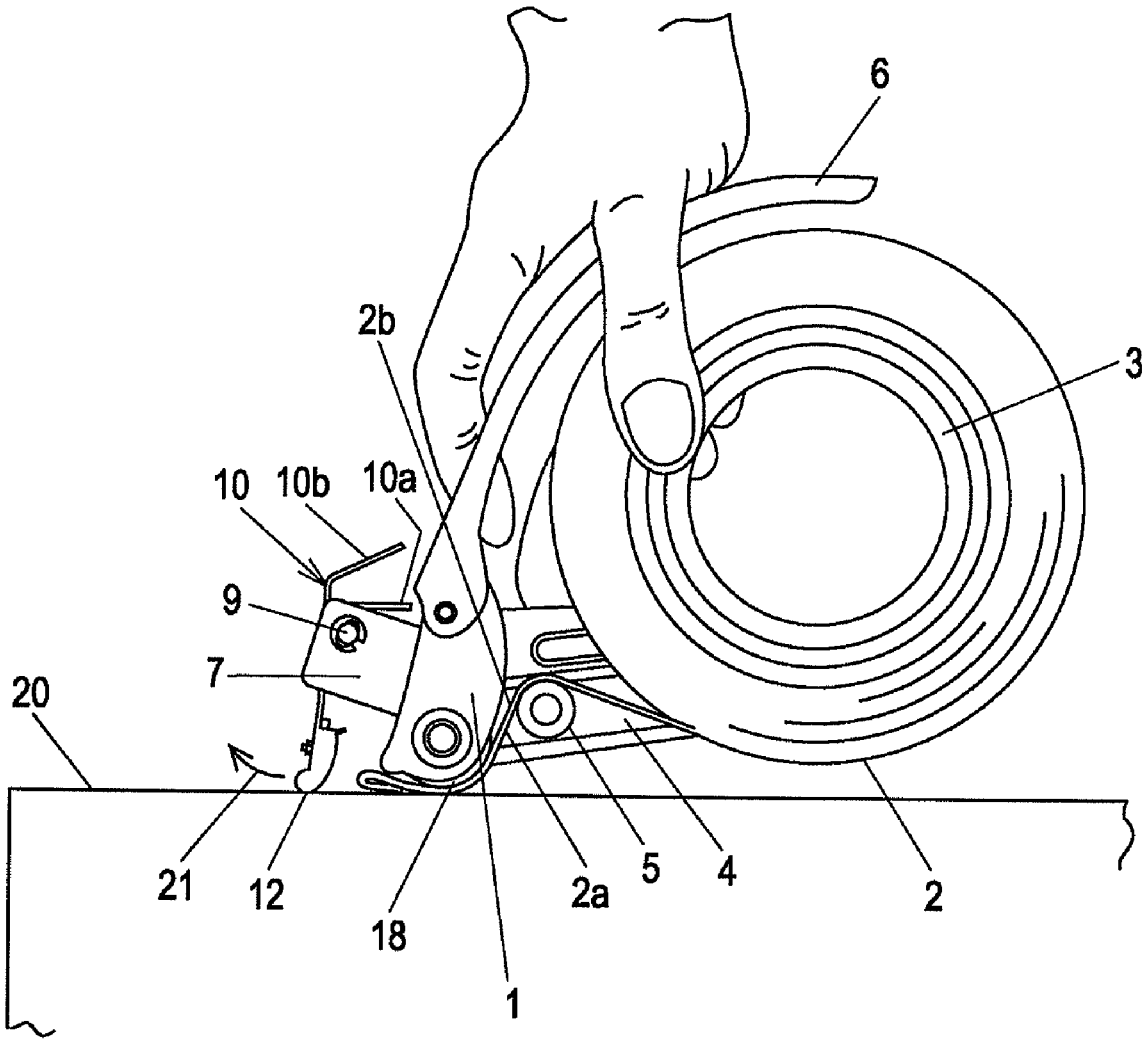
FIG. 11 is used to illustrate the adhesion process of the adhesive tape, and is a side view showing a state when the adhesion operation of the adhesive tape is started.
Figure 12:
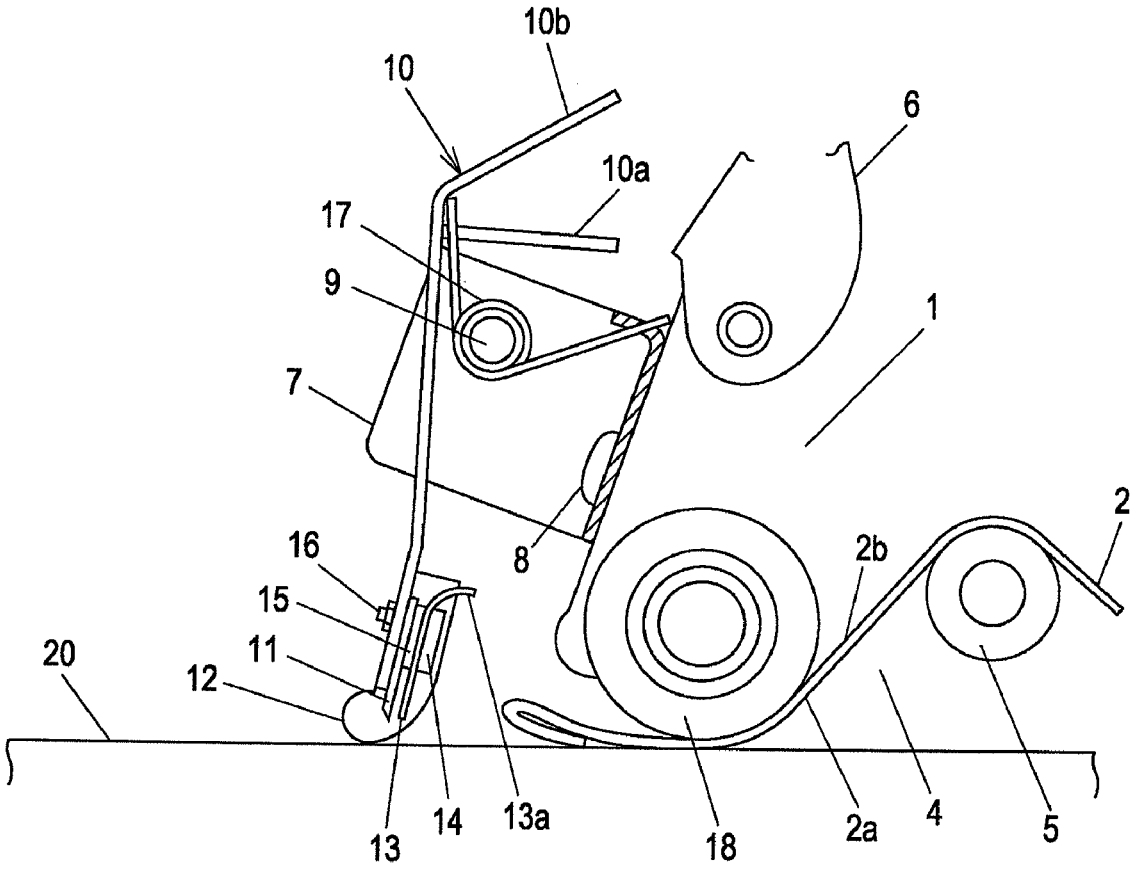
FIG. 12 is an enlarged view of a main portion in a state substantially in correspondence with the state shown in FIG. 11.
Figure 13:
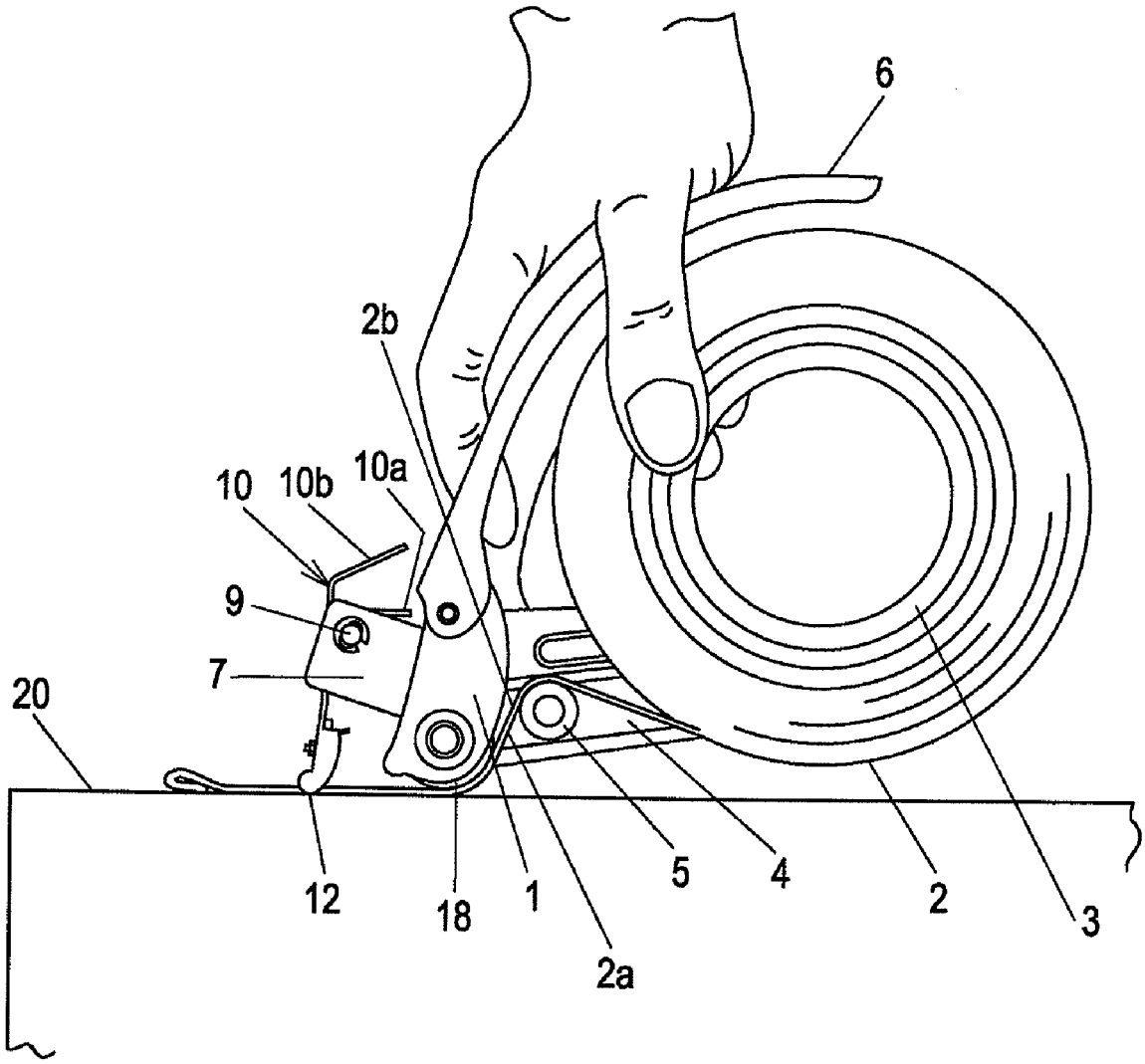
FIG. 13 is used to illustrate the adhesion process of the adhesive tape, and is a side view showing a state in which the adhesion operation of the adhesive tape is being carried out.
Figure 14:
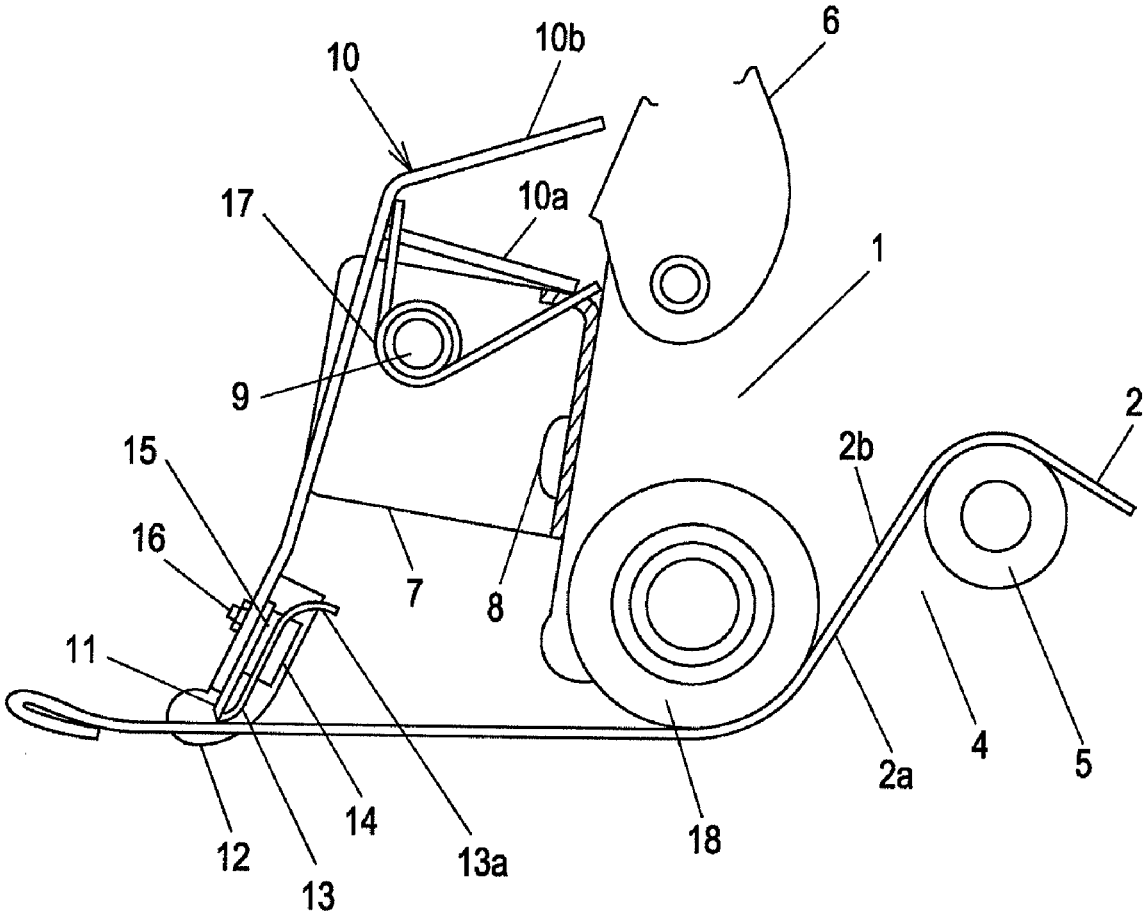
FIG. 14 is an enlarged view of a main portion in a state substantially in correspondence with the state shown in FIG. 13.
Figure 15:
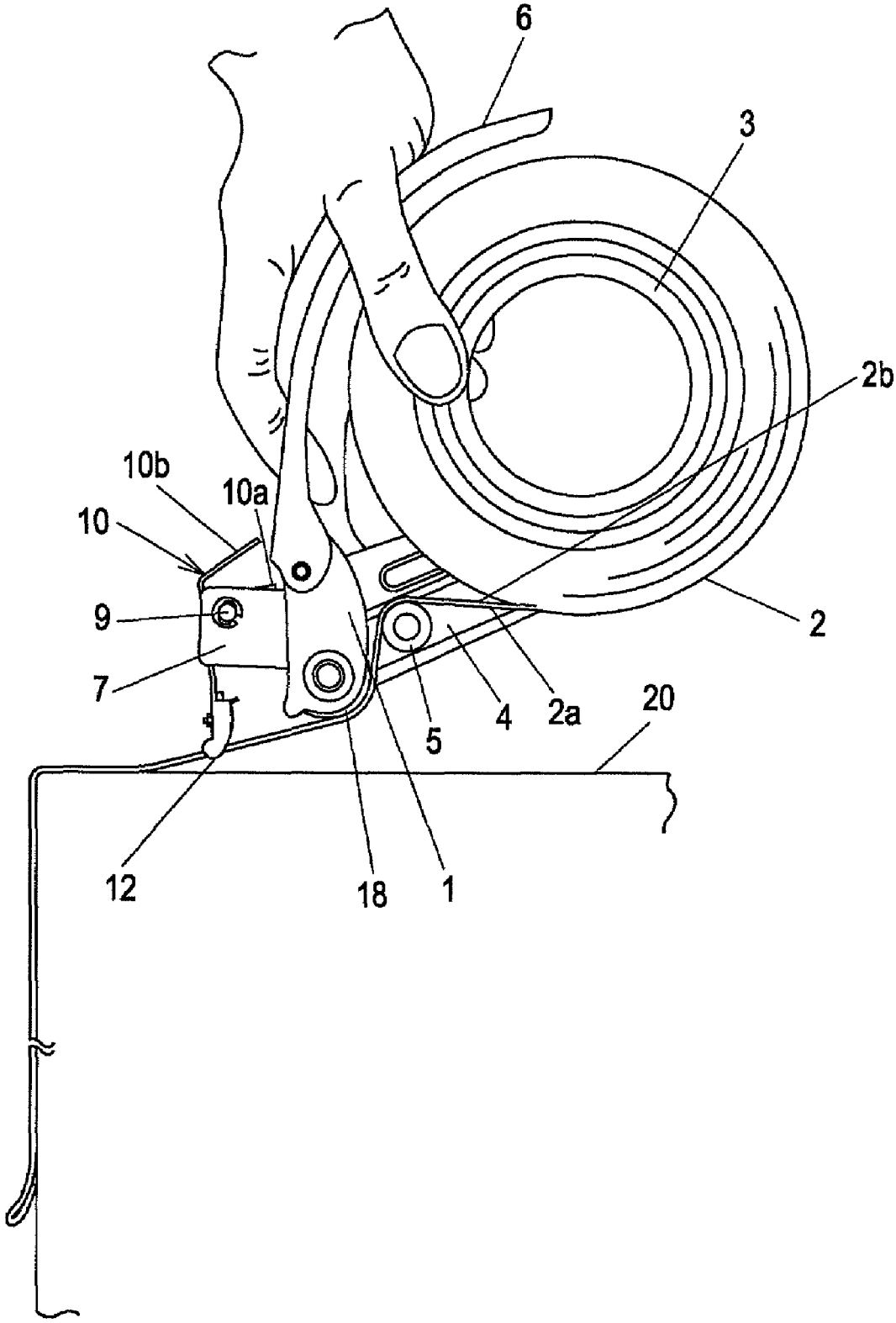
FIG. 15 is used to illustrate the adhesion process of the adhesive tape, and is a side view showing a state when the adhesive tape is being cut.
Figure 16:
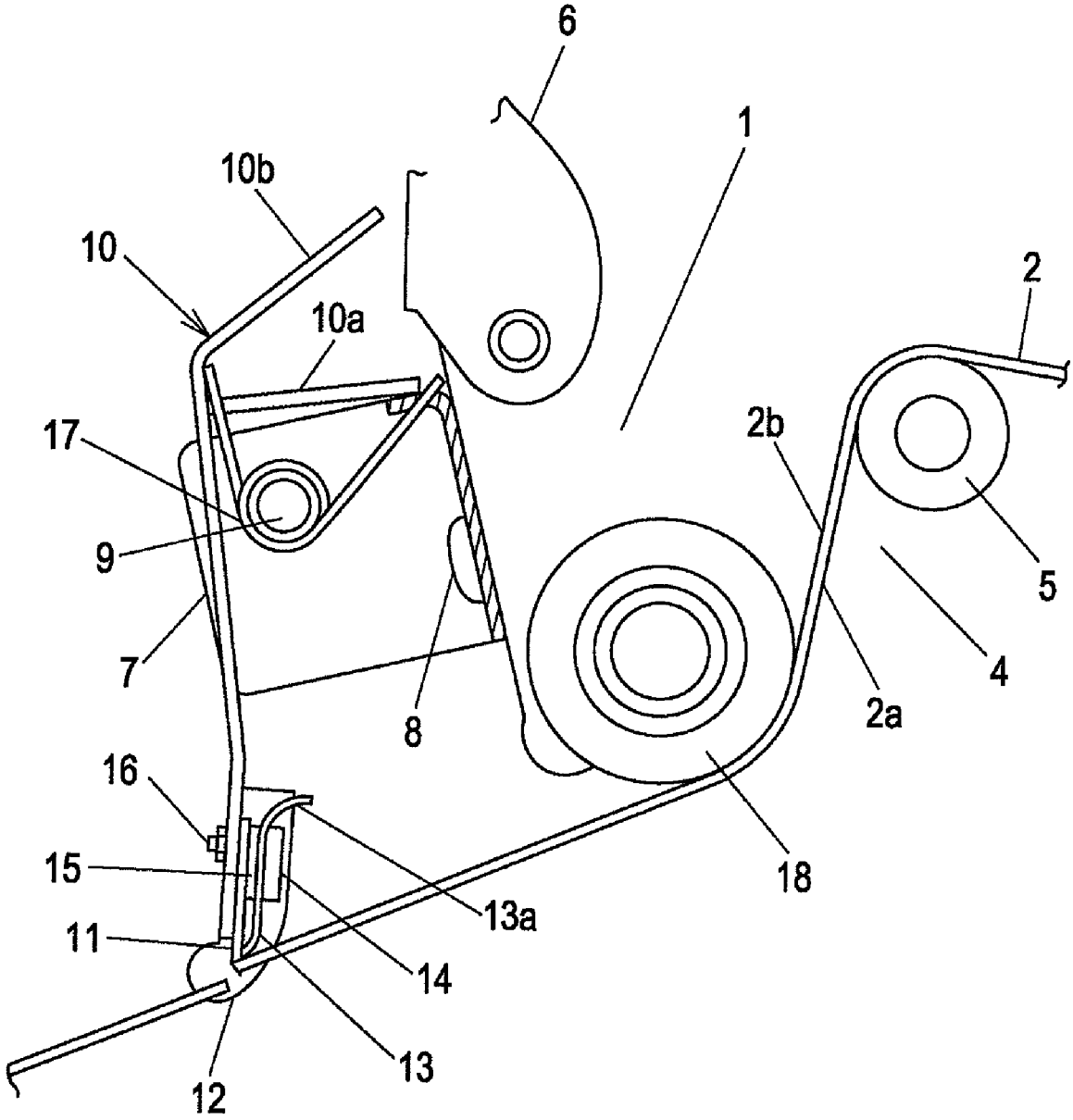
FIG. 16 is an enlarged view of a main portion in a state substantially in correspondence with the state shown in FIG. 15.
Figure 17:
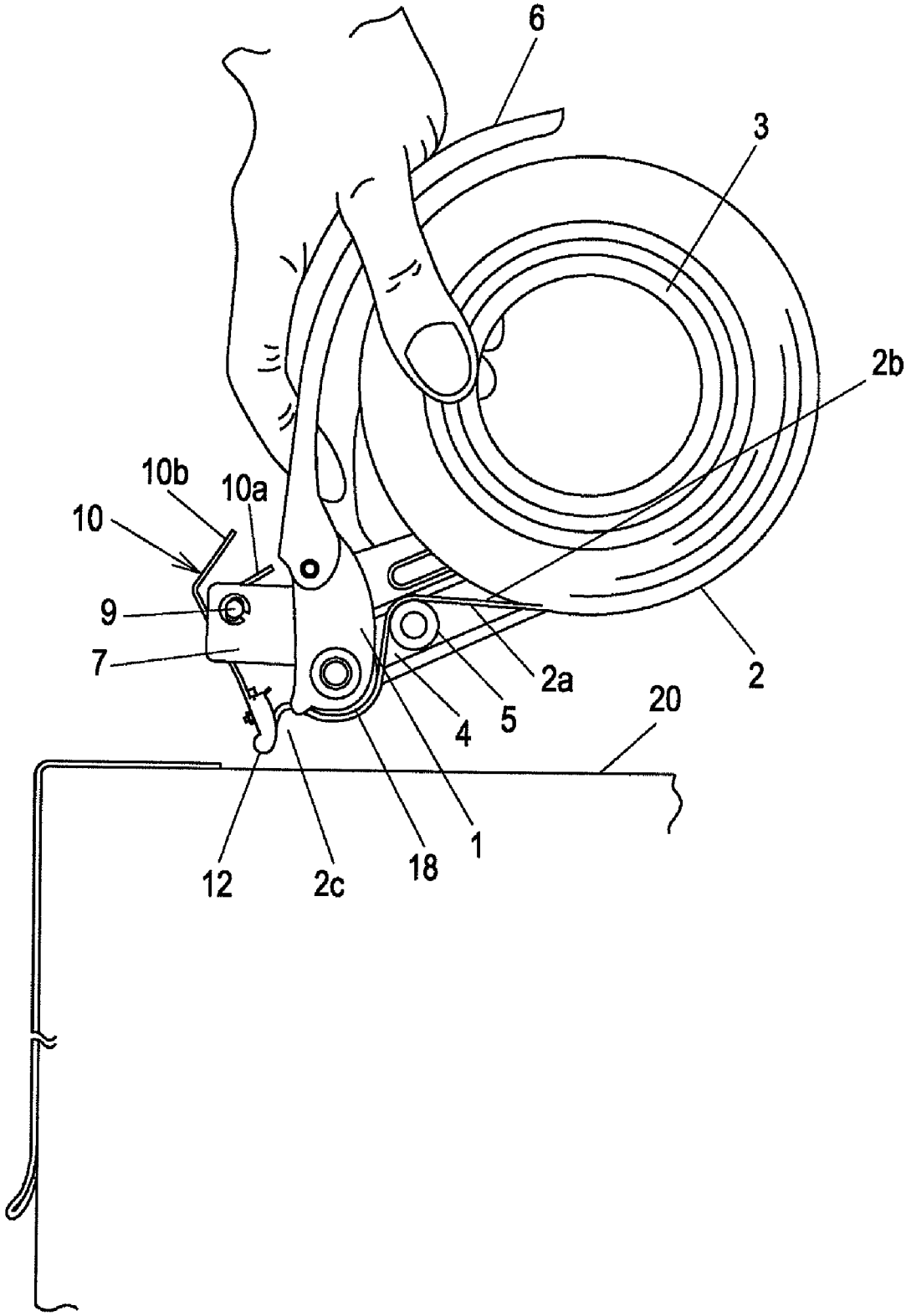
FIG. 17 is used to illustrate the adhesion process of the adhesive tape, and is a side view showing a state immediately after the adhesive tape is cut.
Figure 18:
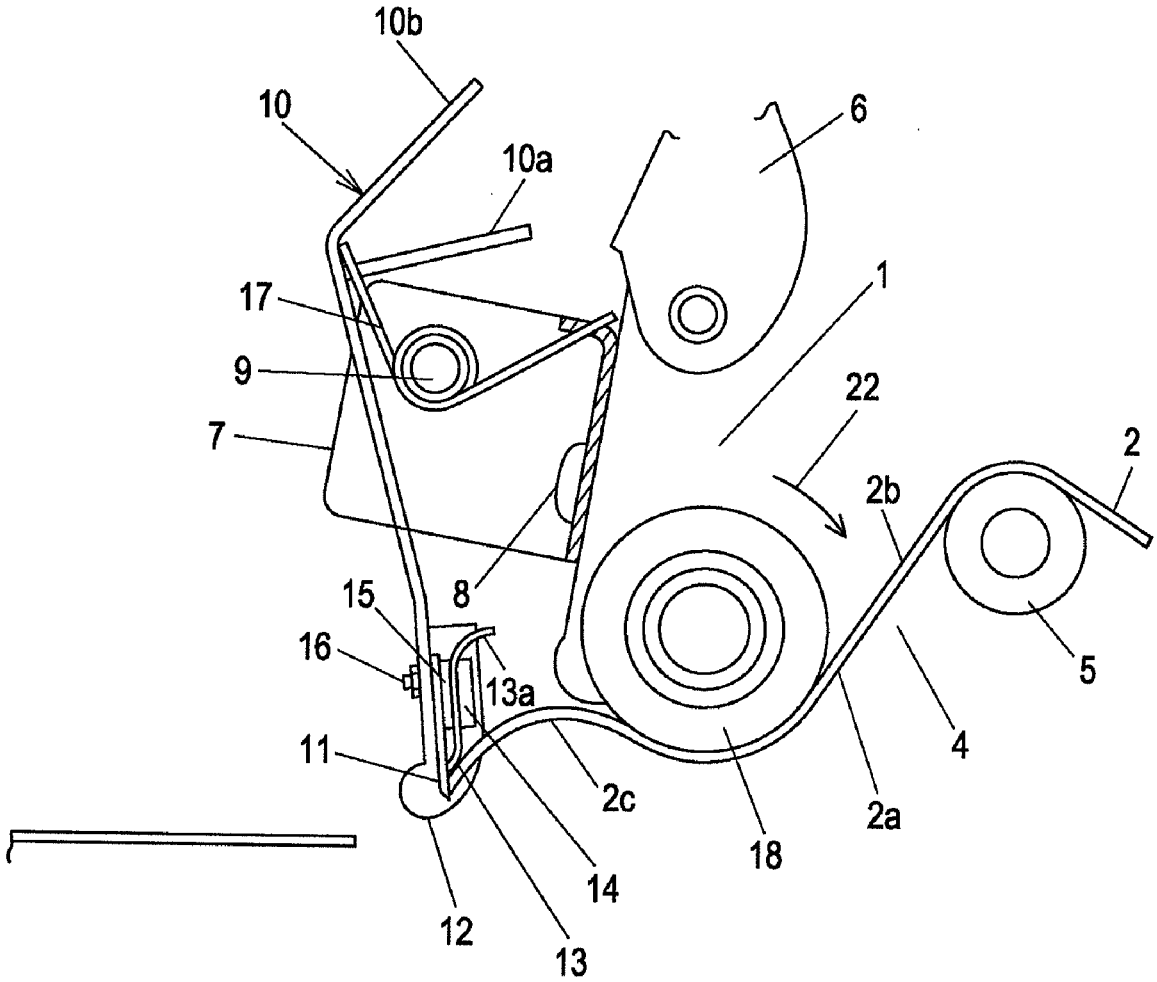
FIG. 18 is an enlarged view of a main portion in a state substantially in correspondence with the state shown in FIG. 17.
Figure 19:
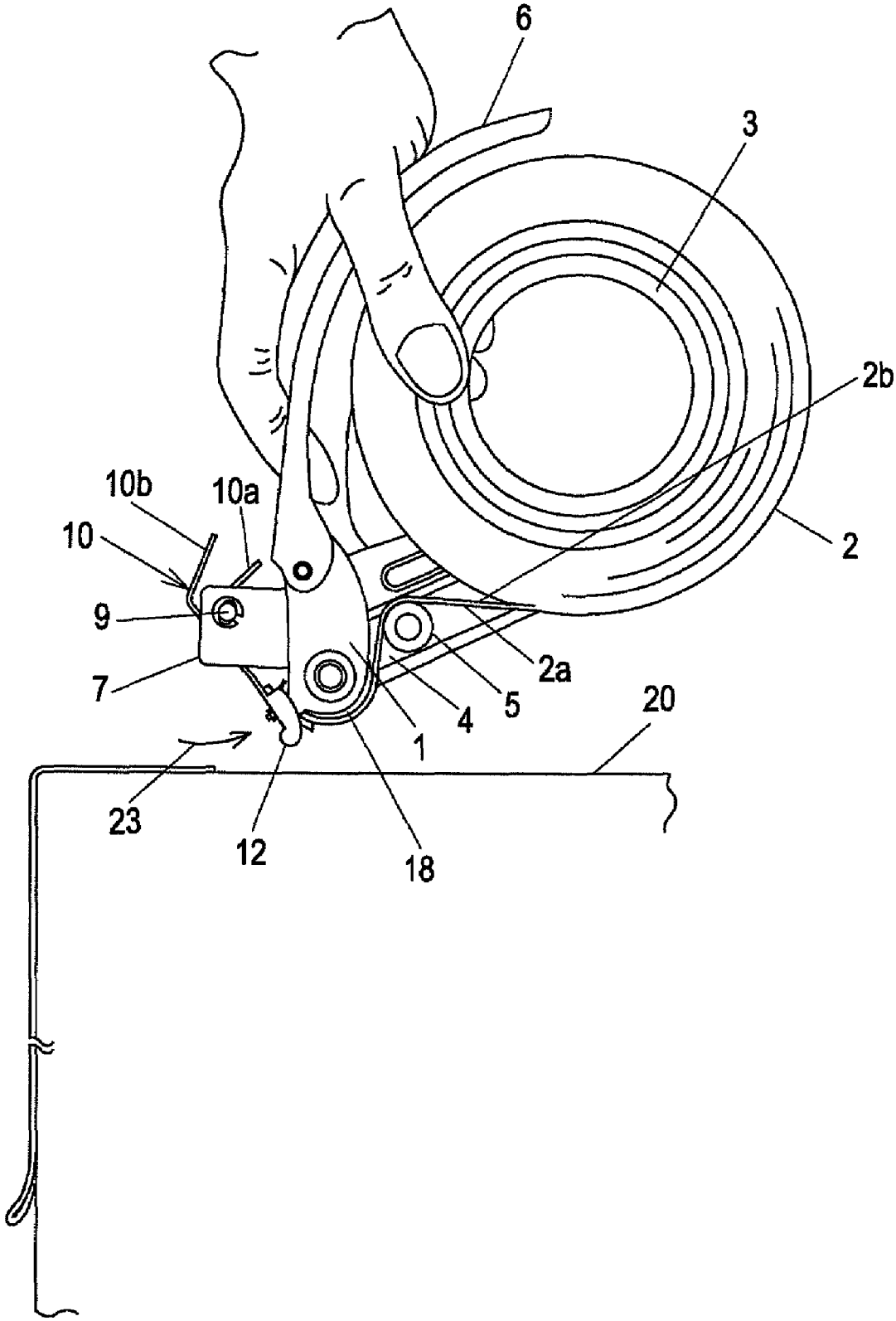
FIG. 19 is used to illustrate the adhesion process of the adhesive tape, and is a side view showing a state when a fold at the cut end portion of the adhesive tape is formed.
Figure 20:
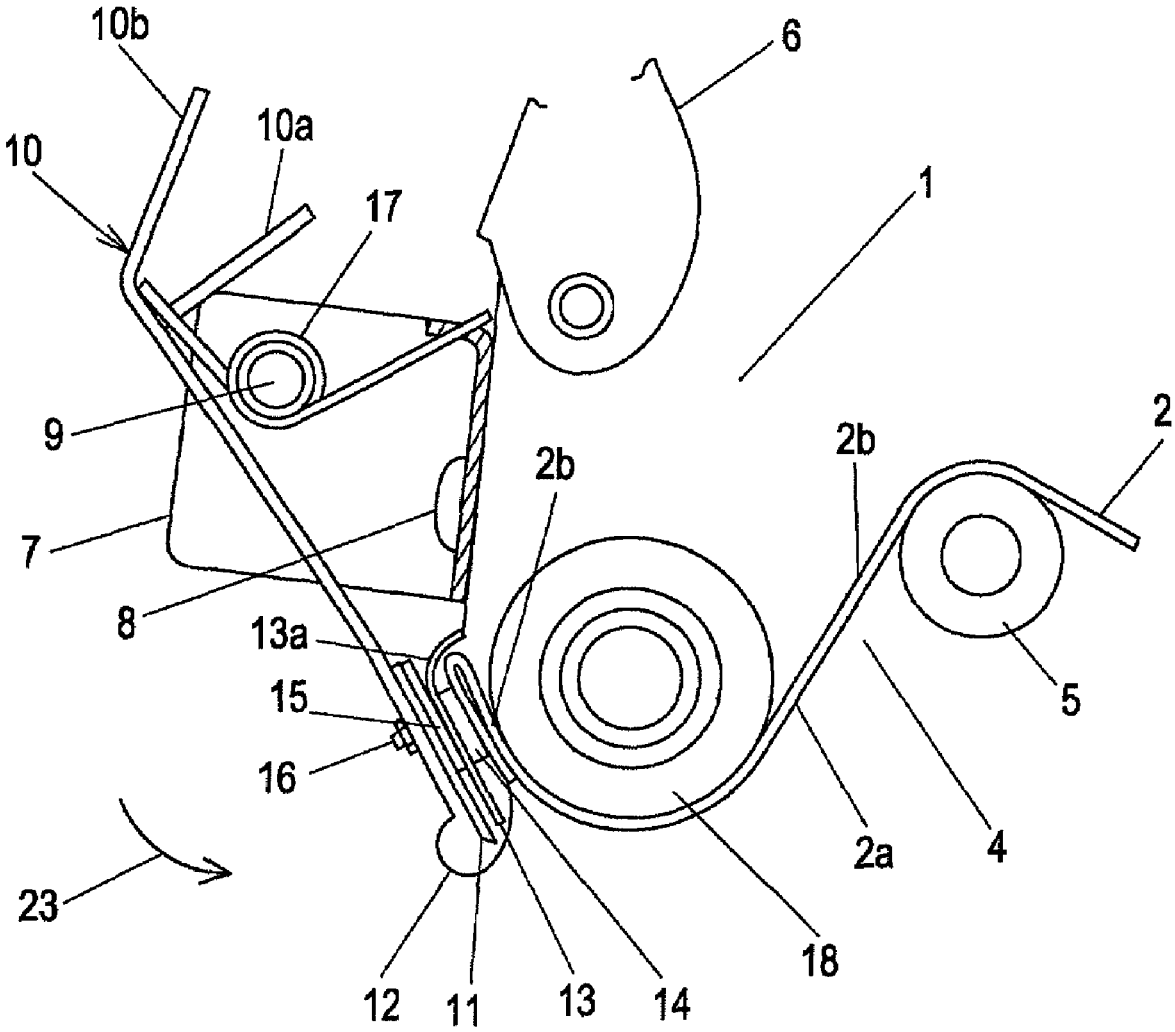
FIG. 20 is an enlarged view of a main portion in a state substantially in correspondence with the state shown in FIG. 19.
Figure 21:
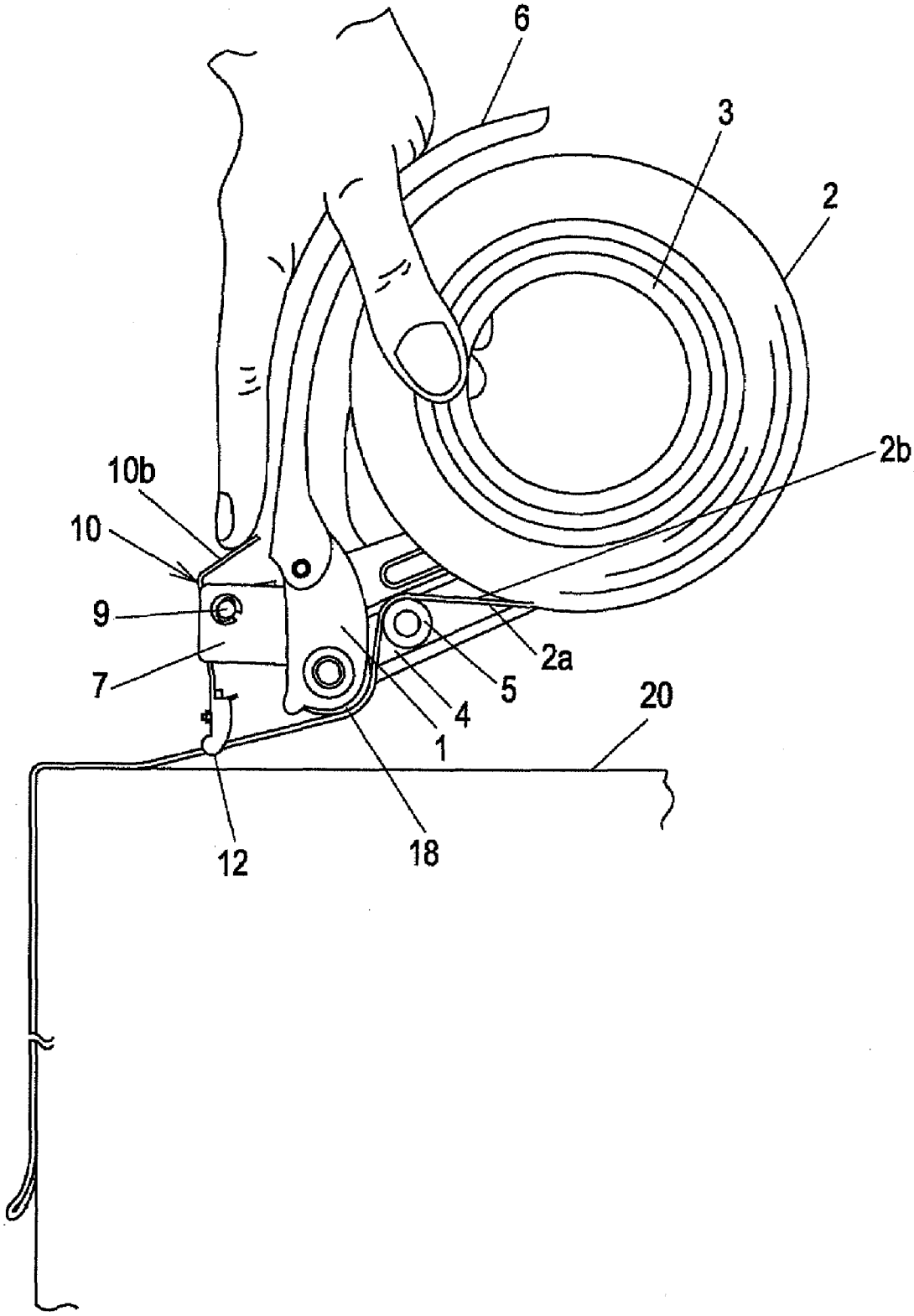
FIG. 21 is used to illustrate the adhesion process of the adhesive tape, and is a side view showing a different method of moving outward the cutting blade 11.

1 body
2 adhesive tape
2*a* adhesion surface
2*b* non-adhesion surface
2*c* flex portion
2*d* fold
3 holding portion
4 drawing-out portion
7 first frame member
10 second frame member
10*a* stopper portion
10*b* finger placing portion
11 cutting blade
11*a* edge (holding portion)
12 protrusion
13 leaf spring (guide member)
13*a* folding positioning portion
14 synthetic resin plate (static electricity generating member)
15 spacer
15*a* spacer
17 torsion spring (biasing member)
18 rotating roller
20 corrugated cardboard (adhesion member)
25 another cutting blade
25*a* edge (holding portion)
26 synthetic resin plate (static electricity generating member)

The invention claimed is:

1. A tape cutter device comprising:

a holding portion capable of holding an adhesive tape having an adhesion surface at one side thereof and a non-adhesion surface at the other side thereof;

a drawing-out portion where the adhesive tape held by the holding portion is drawn out;

a cutting blade that cuts the adhesive tape drawn out from the drawing-out portion, wherein the cutting blade is disposed at the non-adhesion-surface side of the adhesive tape, and is provided so as to be rotatable in a drawing-out direction of the adhesive tape as the adhesive tape is drawn out, a biasing member that biases the cutting blade in a direction opposite to the drawing-out direction of the adhesive tape;

a resin plate secured with the cutting blade, the resin plate generating static electricity;

a rotating roller disposed at the holding-portion side near the cutting blade so that the non-adhesion surface of the adhesive tape is wound thereupon, a rotation of the rotating roller causes the cut end portion of the adhesive tape to be flexed into a recess form so that the adhesion surface is positioned at the inner side, thereby forming a flex portion in the adhesive tape, the flex portion is held by static electricity generated by the resin plate and the rotating roller, the rotating roller rotating as the adhesive tape is drawn out, to form a fold, including a non-adhesion portion, at a cut end portion of the adhesive tape so as to be situated between the rotating roller and the cutting blade when the adhesive tape is cut; and a stopper portion constructed with the cutting blade, the stopper portion restricts a rotation of the finger placing portion, wherein a guide member is provided at an inner-side portion, situated at the holding-portion side, of the cutting blade, the guide member contacts the non-adhesion surface of the adhesive tape drawn out from the holding portion and rotates the cutting blade in the drawing-out direction of the adhesive tape against a biasing force of the biasing member, and wherein the guide member has a curved folding positioning portion.

2. The tape cutter device according to claim 1, wherein the folding positioning portion with which the fold of the adhesive tape comes into contact is provided.

3. The tape cutter device according to claim 1, wherein the stopper portion that restricts an amount of rotation of the cutting blade in the drawing-out direction of the adhesive tape is provided.

4. The tape cutter device according to claim 1, wherein protrusions are disposed on two respective sides of an edge of the cutting blade so as to protrude beyond the edge.

5. The tape cutter device according to claim 3, wherein the finger placing portion that rotates the cutting blade in the drawing-out direction of the adhesive tape against a/the biasing force of the biasing member by a pressing operation with a finger tip is provided.

6. The tape cutter device according to claim 1, wherein a pair of the finger placing portions are provided in correspondence with two respective sides/the two respective sides of the cutting blade.

7. The tape cutter device according to claim 5, wherein the stopper portion restricts the amount of rotation of the cutting blade in the drawing-out direction of the adhesive tape by restricting the amount of rotation of the finger placing portion.

* * * * *